US008044811B2

(12) United States Patent
Uhlhorn et al.

(10) Patent No.: US 8,044,811 B2
(45) Date of Patent: Oct. 25, 2011

(54) SENSING DEVICE AND METHOD

(75) Inventors: Jan Robert Uhlhorn, Tricht (NL); Lambertus Gerardus P. Van Der Heijden, Bunnik (NL); Jan E. Veening, De Meern (NL)

(73) Assignee: Diversey, Inc., Sturtevant, WI (US)

( * ) Notice: Subject to any disclaimer, the term of this patent is extended or adjusted under 35 U.S.C. 154(b) by 312 days.

(21) Appl. No.: 12/514,037

(22) PCT Filed: Nov. 9, 2007

(86) PCT No.: PCT/US2007/084229

§ 371 (c)(1),
(2), (4) Date: May 7, 2009

(87) PCT Pub. No.: WO2008/060991

PCT Pub. Date: May 22, 2008

(65) Prior Publication Data

US 2011/0018728 A1 Jan. 27, 2011

(30) Foreign Application Priority Data

Nov. 10, 2006 (EP) ..... 06123860

(51) Int. Cl.
*G08B 21/00* (2006.01)

(52) U.S. Cl. ..... 340/618; 340/620; 347/25

(58) Field of Classification Search ..... 340/601, 340/602, 603, 618, 620, 657; 374/16, 17, 374/25, 163, 186; 219/489, 497; 73/204.16, 73/204.24

See application file for complete search history.

(56) References Cited

U.S. PATENT DOCUMENTS

| | | | | |
|---|---|---|---|---|
| 4,770,540 | A * | 9/1988 | Chague et al. | 374/17 |
| 4,853,638 | A | 8/1989 | Endou et al. | |
| 5,195,826 | A | 3/1993 | Enderle et al. | |
| 6,553,828 | B1 * | 4/2003 | Thurmond | 73/204.16 |
| 6,590,188 | B2 * | 7/2003 | Cline et al. | 219/497 |
| 7,090,392 | B2 * | 8/2006 | Leonhardt | 374/25 |
| 7,318,004 | B2 | 1/2008 | Butterfield | |
| 2004/0042772 | A1 * | 3/2004 | Whitford et al. | 392/498 |

FOREIGN PATENT DOCUMENTS

| | | |
|---|---|---|
| EP | 1704810 | 9/2006 |

OTHER PUBLICATIONS

The International Search Report prepared by the Korean Intellectual Property Office, Apr. 1, 2007.

* cited by examiner

*Primary Examiner* — Van T. Trieu
(74) *Attorney, Agent, or Firm* — Gregory S. Bollis

(57) ABSTRACT

The invention relates to a method and sensing device capable of determining a temperature of a liquid and an electrical conductivity of the liquid at the temperature. The sensing device comprises at least one temperature sensor for providing temperature measurement data arranged such that the temperature sensor is physically isolated from the liquid when the sensing device is immersed in the liquid. The device further comprises an electrical conductivity sensor, storage means containing temperature characteristics and a processor. The processor is arranged for instantly measuring an electrical conductivity of a liquid and for evaluating temperature measurement data for determining the temperature of the liquid on the basis of the temperature characteristics.

23 Claims, 5 Drawing Sheets

SENSING DEVICE AND METHOD

FIELD OF THE INVENTION

The invention relates to a sensing device and a method of using such a device. In particular, the invention relates to a sensing device capable of determining a temperature of a liquid, preferably a washing liquid, and an electrical conductivity of said liquid at said temperature.

BACKGROUND OF THE INVENTION

Sensing devices for determining an electrical conductivity and temperature can be used for the monitoring of (dish) washing processes in order to e.g. determine the concentration of detergent available for the (dish)washing process and to re-dose (fill) detergent if required. Although the electrical conductivity is a measure for the concentration of detergent, the temperature is measured as well, since the electrical conductivity is temperature-dependant.

U.S. Pat. No. 4,733,798 describes a method and apparatus for controlling the concentration of wash water in a ware washing machine, in which the conductivity of the ware washing solution is measured, as well as the temperature, in order to compensate for the apparent concentration changes solely associated with changes in temperature of the washing solution.

EP 1 704 810, in the name of the present applicant, describes a self-contained and wireless monitoring device, e.g., for monitoring a washing process inside a relatively small industrial dishwashing machine, which device monitors the electrical conductivity and temperature of the washing liquid. The temperature sensor in the monitoring device is physically isolated from the liquid in the sense of being encapsulated by a material that protects the sensor against the harsh chemical environment wherein the monitoring device operates during dishwashing. The disclosed monitoring device uses a stored threshold value of the electrical conductivity below which the detergent concentration in the washing liquid is considered too low and a user is alerted.

A problem in determining the amount of detergent by measuring the electrical conductivity and temperature, is that the quality, in particular the electrical conductivity, of water without detergent varies from one geographical region to another. This variation may be larger than the influence of the addition of detergent. In order to compensate for this variation to determine a reliable threshold value, it is desirable to obtain information on the electrical conductivity and the temperature at which that electrical conductivity of the washing liquid without dissolved detergent was determined. Users of the sensing devices, however, frequently immerse the sensing device in the washing liquid almost simultaneously with adding the detergent to the liquid. Whereas the electrical conductivity of the water can be measured quickly, the associated temperature cannot as a result of the physical encapsulation of the temperature sensor in the sensing device.

Therefore, a need exists in the art for a sensing device that is capable of quickly and accurately determining a temperature of a liquid and an electrical conductivity at that temperature.

SUMMARY OF THE INVENTION

It is an object of the invention to provide such a sensing device. This object is realised by a sensing device as defined in claim 1 and a method as defined in claim 15.

The invention allows to determine both the electrical conductivity and the temperature of the essentially detergent free liquid. The electrical conductivity is measured substantially instantly, preferably within 30 seconds from the immersion in the liquid, more preferably within 20 seconds, still more preferably within 15 seconds, and most preferably within 10 seconds for determining the electrical conductivity. The electrical conductivity may be measured by measuring the electrical resistance. It is noted that within these time limits, instead of a single measurement, multiple measurements may be performed. These multiple measurements may be averaged to determine the electrical conductivity of the essentially detergent free liquid. Since the temperature sensor is physically isolated from the liquid, the temperature of the water for which the electrical conductivity has been substantially instantly measured is determined by evaluating temperature measurement data during only a fraction of the temperature response characteristic of the sensor between an initial temperature and an intermediate temperature. The time related to this evaluated fraction is chosen such that detergent has not yet significantly dissolved in the liquid. It is not necessary to wait until the sensor reaches the temperature of the liquid, at which temperature the conductivity of the liquid was measured, since the temperature response characteristics enable a quick and accurate determination of the liquid temperature. Consequently, both the electrical conductivity and the temperature related to that electrical conductivity can be determined quickly and reliably.

An embodiment of the invention is defined in claims 2 and 16. This further temperature may be a reference temperature at which the electrical conductivity of the detergent dissolved in said liquid is known, and which temperature is close to the actual washing temperature, or is the actual washing temperature.

A further embodiment of the invention is defined in claims 3 and 15. It has been established that for such fractions of the temperature interval, the temperature of the liquid can be determined accurately by extrapolation in a sufficiently quick manner.

Another embodiment of the invention is defined in claims 4 and 16. This embodiment corresponds to practical application situations of the sensing device, wherein the sensing device is at room temperature and the liquid is approximately 40-60° C.

Still other embodiments of the invention are defined in claims 5-7 and 16-18. By selecting a fixed temperature change properly, a short timing measurement can be made with a high accuracy for determination of the temperature of the liquid associated with the instantly measured electrical conductivity.

In the embodiment as defined in claims 8 and 19, a measure is defined for the situation wherein the sensing device for the first time is immersed in a liquid already containing dissolved detergent. A threshold determined on the basis of the thus obtained electrical conductivity is not reliable. When the sensing device is later immersed in a liquid substantially free from dissolved detergent, the originally stored electrical conductivity is replaced by the determined appropriate electrical conductivity for establishing a reliable threshold.

The embodiment of the invention as defined in claims 9 and 20 is advantageous in that the threshold indicative of shortage of detergent is established automatically. In case the temperature of the liquid for which the electrical conductivity was determined instantly is substantially equal to the actual temperature of the dishwashing process, the instantly determined electrical conductivity may be used instead of the corrected electrical conductivity. The stored data concerning the electrical conductivity of a detergent dissolved in the liquid may be simply a constant value, as well as more complex data, such as a curve fit, and may depend on multiple factors, e.g., the chemical constitution of the detergent.

The embodiment of the invention as defined in claims 10-12, 21 and 22 provides a suitable sensing device capable of alerting a user of shortage of detergent in a washing liquid of a dishwashing machine.

The invention will hereafter be described on the basis of the accompanying drawings, schematically showing an embodiment of the invention. It will be clear that the invention is in no manner limited by these examples of embodiments.

SHORT DESCRIPTION OF DRAWINGS

In the figures:

FIG. 1 illustrates a floating body for a sensing device according to an embodiment of the invention;

FIG. 2 schematically illustrates the sensing device incorporated in the floating body of FIG. 1;

FIG. 3 schematically illustrates temperature response characteristics as used in a sensing device according to the invention;

DETAILED DESCRIPTION OF THE DRAWINGS

Figure 2:
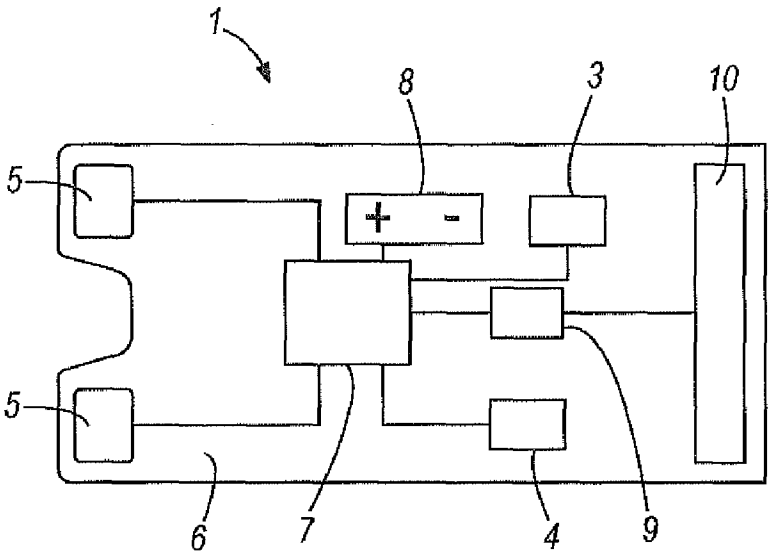
Figure 1:
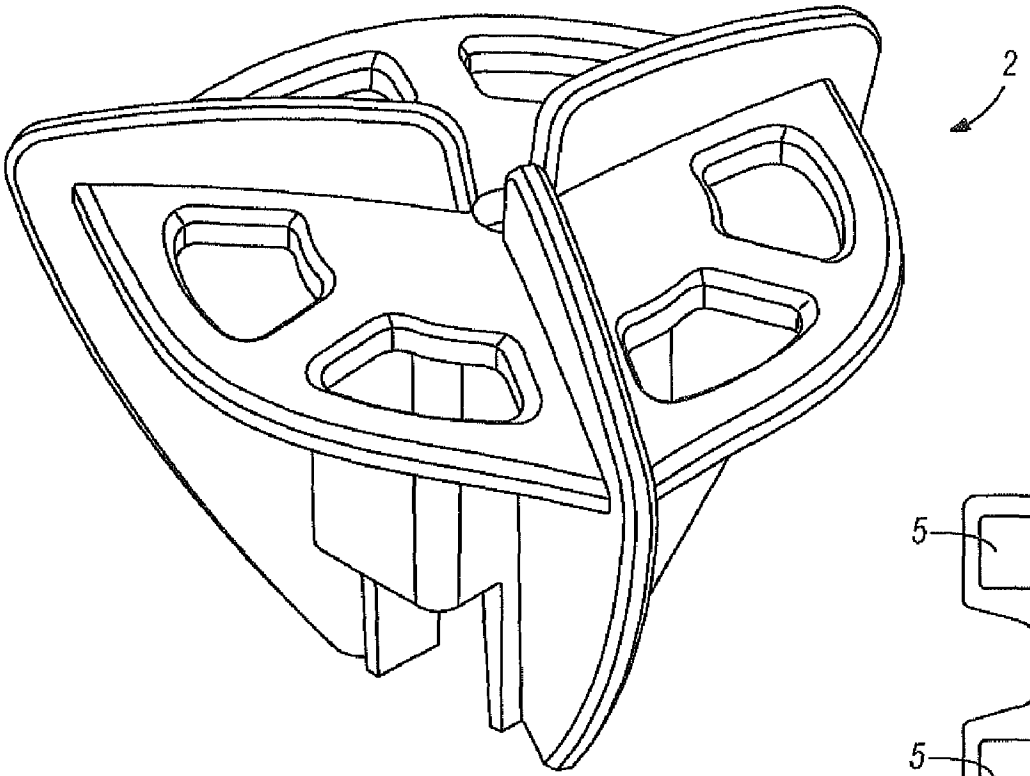

FIGS. 1 and 2 show a schematically illustrated sensing device 1 incorporated in a housing 2 according to an embodiment the invention. In the shown embodiment, the sensing device 1 is self-contained and wireless, capable of floating in liquid in a dishwashing machine (not shown) and of inspecting the concentration of detergent in said machine as described in European patent application EP 1 704 810 of the applicant that is incorporated in the present application by reference. After assembly of the sensing device 1 in the housing 2 thereof, and encapsulating the device 1 in resin within the housing 2, the latter protects the circuitry of the sensing device 1 against the hostile environment constituted by the washing water.

It is noted that washing liquid typically remains within a washing machine after completion of a washing cycle for several cycles. The monitoring device can be provided in the washing machine before a (series of) washing cycle(s), simply by putting (disposing) it in the washing liquid.

In FIG. 2, the sensing device 1 comprises a temperature sensor 3, which, when the device 1 is mounted in its housing 2, is physically isolated from the outside by the housing 2, hence from any liquid in which the sensing device 1 may be immersed. The sensing device 1, being a self-contained device, comprises an internal energy source 8 in order to perform its monitoring and signalling functions. In the shown embodiment, the energy source is a battery 8. The sensing device 1 also comprises a conductivity sensor, consisting of two electrodes 5, provided on different positions on the circuit board 6. An appropriate lay-out of the electrodes is known to any person skilled in the art. The electrodes 5, when activated by a processor 7, provide measurement data for determining an electrical conductivity of the liquid between the electrodes 5.

The processor 7 serves, among other things, for processing conductivity measurement data from the electrodes 5 and temperature measurement data from the temperature sensor 3.

Storage means 4 contain a number of temperature response characteristics of the temperature sensor 3, which response characteristics will be described in more detail below with reference to FIG. 3.

The processor 7 is arranged such that it activates itself upon detection that the sensing device 1 is immersed in liquid, via a substantial instant measurement of the electrical conductivity between the electrodes 5, and starts to determine the electrical conductivity on the basis of the measurement data of said conductivity sensor. As an example, the measurement is performed five times, with intervals of approx. 2.3 seconds, and the measured conductivities are subsequently averaged to determine the electrical conductivity of the substantially detergent free liquid. Furthermore, the processor 7 evaluates the temperature measurement data of the temperature sensor 3 measured in a fraction of the temperature interval between an initial temperature and an intermediate temperature that is below the temperature of the liquid after immersion of the sensing device 1 in the liquid, and thereby determines the temperature of the liquid using the stored temperature response characteristics in the storage means 4. As a result of the temperature interval measured being only a fraction of the temperature interval between the initial temperature of the sensing device 1 and the liquid surrounding it, the determination of the liquid temperature can be made quickly as will be explained hereafter.

The actual washing temperature is not necessarily identical to the temperature of the liquid at the moment of immersion of the sensing device 1, for instance because the water may be a little colder than an ideal washing temperature, due to, e.g., the addition of cold detergent-free water in order to compensate for a loss of water during drainage of the washing water at the end of the previous washing cycle. Therefore, the storage means 4 contains correction data concerning a temperature dependence of the electrical conductivity of a detergent free liquid, and the processor 7 is arranged for correcting the determined electrical conductivity on the basis of the correction data to determine a corrected electrical conductivity at a further temperature. The further temperature represents a washing temperature. The correction data contains in the present embodiment a formula having as input data the temperature of the water with substantially dissolved detergent and as output data the electrical conductivity of the water at the further temperature.

In the shown embodiment of the invention, the correction data consists of a number of curves, whereby each such curve relates, for detergent-free water having a given hardness, the conductivity of that water to its temperature.

In the sensing device 1, the processor 7 is arranged for storing in said storage means 4 a measured and/or determined electrical conductivity value, and for replacing said stored value by another measured electrical conductivity value if, in a later washing session, said other measured electrical conductivity value is lower than the stored value. By means of this replacement, it is guaranteed that the electrical conductivity of detergent-free water is measured in the cleanest water in which the sensing device 1 was emerged since its first measurement, and thus that the stored conductivity is the best value to represent the water hardness in the region wherein the dishwasher is installed.

The processor 7 of the sensing device 1 further is arranged for determining a threshold value for the electrical conductivity, such that the threshold value indicates a shortage of detergent in the liquid. For said determination of the threshold value, the processor 7 uses data of the electrical conductivity of a detergent dissolved in the liquid, which data is stored in the storage means 4. If the temperature of the washing liquid is substantially equal to the temperature for which the electrical conductivity was determined, the threshold is determined by summing the conductivity of the detergent and the conductivity of the washing liquid. If the temperature of the washing liquid is substantially different from the temperature for which the electrical conductivity was determined instantly (i.e. the further temperature differs from the temperature of the liquid), the threshold is obtained by summing the conductivity of the detergent and the corrected electrical conductivity.

The processor 7 is further arranged such that, after determining a value of the electrical conductivity of detergent-dissolved washing liquid, it provides an alarm signal to a RF-transmitter 9, which on its turn transmits a signal, using an antenna 10. The latter signal then is received by a receiver (not shown), which flashes a light and/or produces an audible beep-signal in order to prompt an operator of the washing machine to replenish detergent. In an alternative embodiment, also not shown, the receiver is part of a self-contained automatic dosing unit positioned at the washing machine, and activates this unit. In an alternative embodiment, two-way communication between the sensing device 1 and a receiver/transmitter is possible, for instance, for asking the sensing device 1 whether the amount of detergent is still sufficient, and to obtain an answer thereupon. Alternative suitable embodiments with regard to signalling are described in European patent application EP 1 704 810 of the applicant that is incorporated in the present application by reference.

Figure 3:
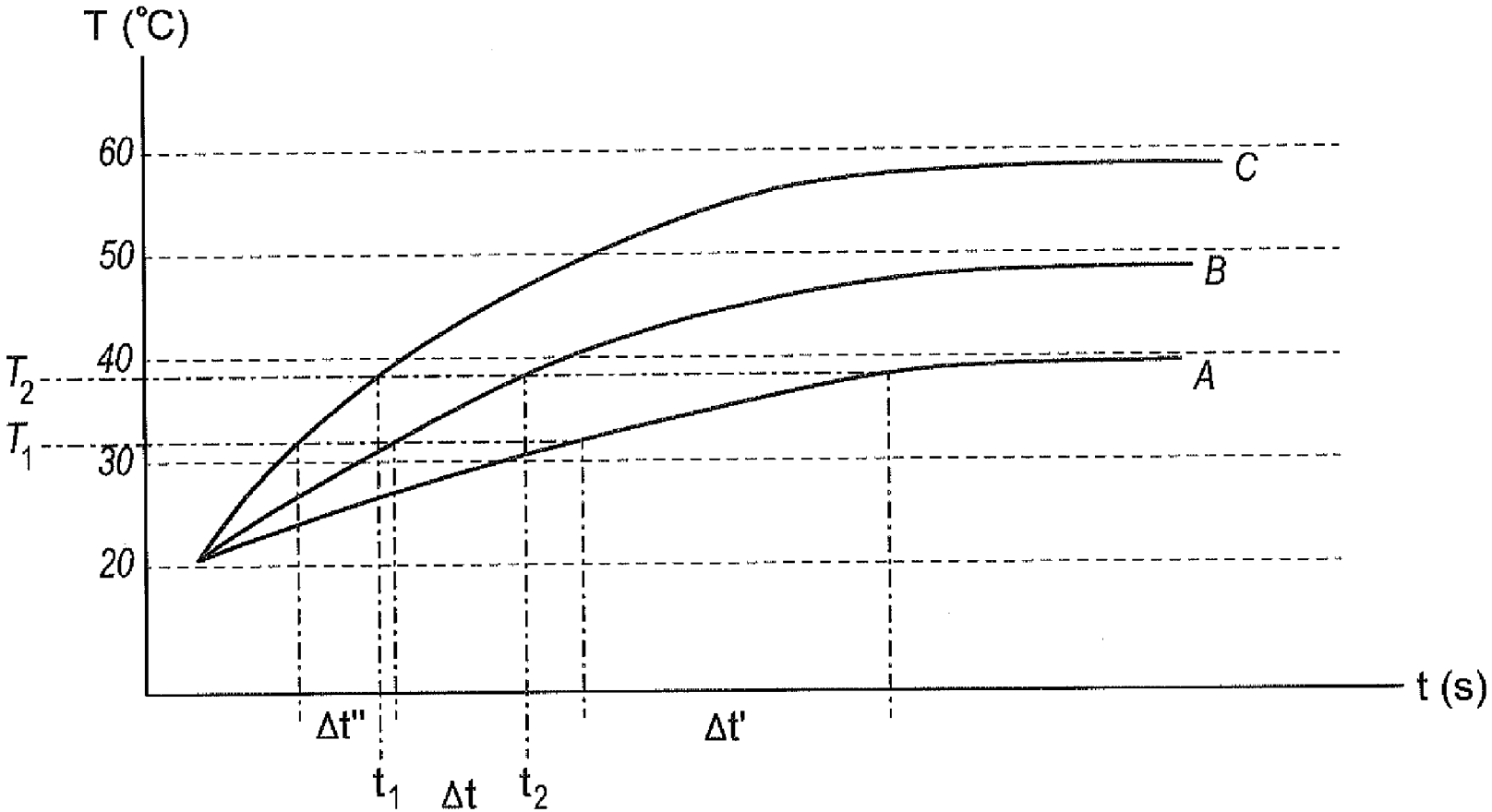

In FIG. 3, three temperature response characteristics A, B and C are shown as stored in the storage means 4 of the sensing device 1. The characteristics represent the thermal response, i.e., the temperature change as a function of time, of the sensor as would occur when the sensing device as a whole, having an initial temperature, is immersed in a liquid that is essentially identical in composition to the detergent-free washing liquid, which in this case is water, and that has a temperature differing from said initial temperature. The characteristics A, B and C were obtained for an initial temperature of the sensing device 1 of 20° C. and liquid temperatures of 40° C., 50° C. respectively 60° C.

The characteristics A, B and C were obtained by immersing a sensing device 1 in water and measuring the thermal response of the device. Alternatively, they may be obtained in other ways, e.g., by mathematical modelling and numerical simulation of the thermal response of the device. The representation of the characteristics A, B and C in the storage means 4 may be any format suitable for storing, for instance a mathematical formula or a numerical table.

Using said temperature response characteristics A, B and C, the processor 7 determines the temperature of the washing water as follows. First, after immersion of the device 1 in the water, it measures a fixed temperature rise using the temperature sensor 3, and measures the amount of time this takes in the processor 7. In FIG. 3, the temperature rise is indicated by the increase between T1 (the initial temperature) and T2 (the intermediate temperature) and the time by t1, t2. Then, the processor 7 calculates $\Delta t = t2 - t1$ and identifies which curve best matches T1, T2 and $\Delta t$; in FIG. 3, this is curve B, having an end temperature of 50° C. Other ways of determining the temperature of the liquid, using the characteristics, are conceivable, such as using a fixed time interval and a variable temperature interval. However, a fixed temperature interval has the advantage of allowing for a particularly quick and accurate determination of the liquid temperature. In FIG. 3, T1 and T2 are respectively 32.5° C. and 37.5° C., thus the interval is 5° C., which means that measurement takes place in a relatively small fraction of the temperature interval between 20° C. and 50° C., the fraction being less than 0.25. The measurement takes place shortly after immersion, as a result of which the measurement lies in a part of the heating response that has a relatively large temperature gradient. As a result, the water temperature can be determined fast as well as accurately, whereas an eventual detergent has not yet dissolved in the washing liquid.

Obviously, if a time $\Delta t'$ or $\Delta t''$ is determined, the temperature of the liquid is determined as 40° C. or 60° C., respectively.

Figure 4:
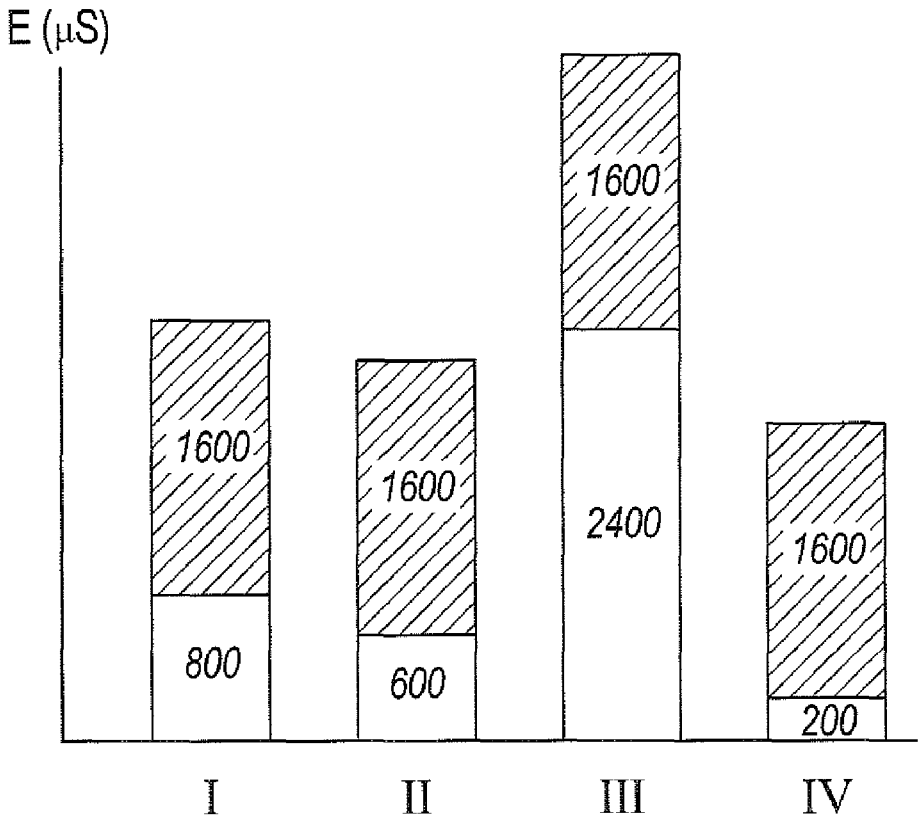
FIG. 4 is a bar diagram that schematically demonstrates the electrical conductivity of water containing detergent, for several geographical regions differing in water hardness.

FIG. 4 illustrates the differences in water hardness between four regions, I, II, III respectively IV, and the influence of these differences on the total electrical conductivity E in μS of detergent-containing washing liquid. For instance, in region III, the water is hard and contributes 2.400 Siemens to the electrical conductivity of the water, whereas the contribution of the concentration of detergent that just suffices for washing contributes only 1.600 Siemens. It has appeared that the total conductivity of the water is essentially the sum of these two individual conductivities. This sum is equal to a threshold value that may be automatically set by the method and device according to the described embodiment of the invention for signalling shortage of detergent.

Figure 5:
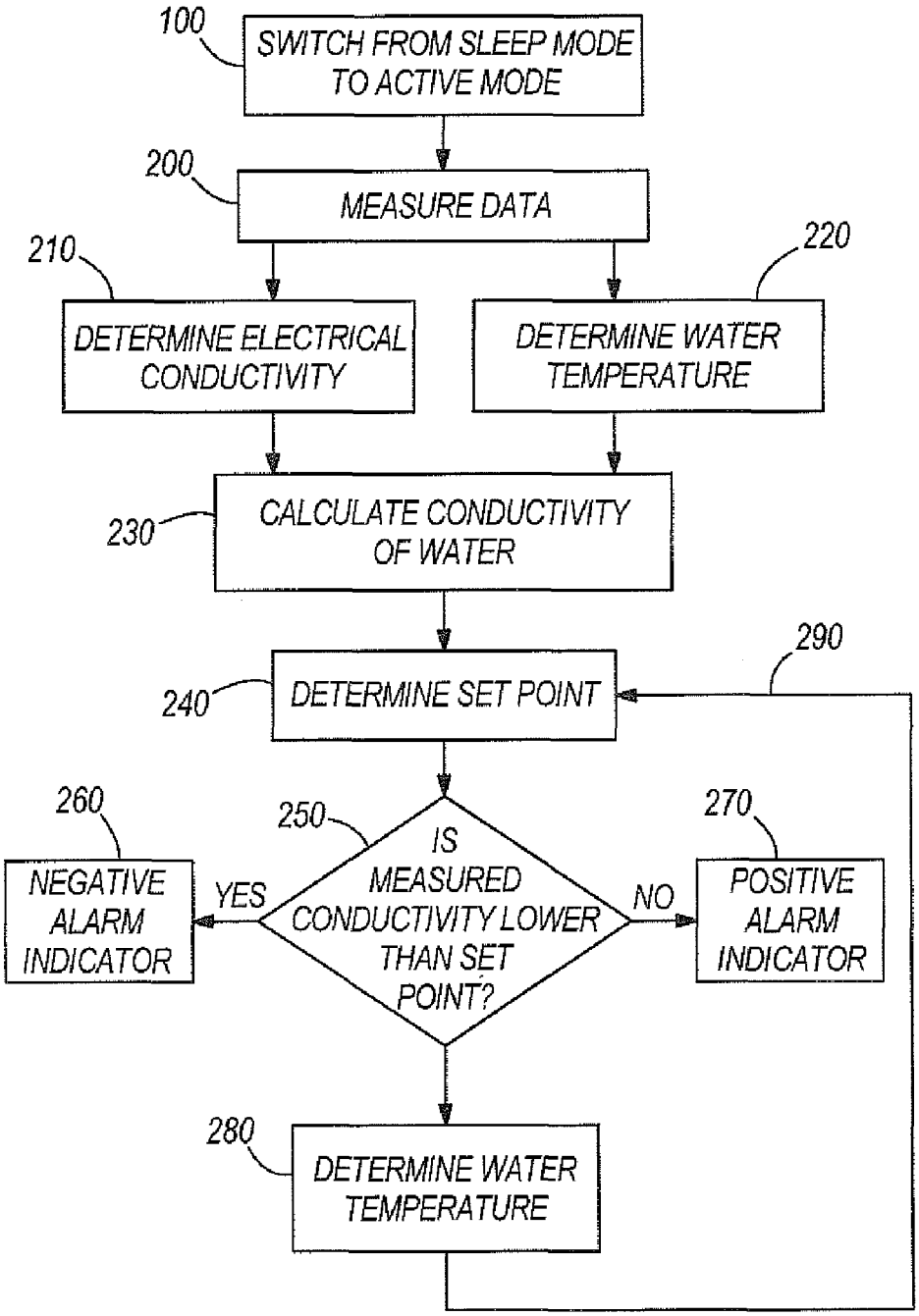
FIG. 5 is a block diagram that schematically illustrates the method according to the invention as implemented in the device of FIG. 1.

FIG. 5 illustrates the method according to the invention, as implemented in the device of FIG. 1. First, in step 100, the device switches, on immersion in water, from its sleep mode to its active mode and starts measuring data for determining the electrical conductivity and water temperature, in step 200. Next, in step 210, the electrical conductivity is determined from measured electrical resistance data; this will be described in more detail in FIG. 6. In parallel with step 210, the temperature of the water is determined, in step 220, by evaluating temperature measurement data as obtained between an initial temperature of 32.5° C. and an intermediate temperature of 37.5° C. after the device is immersed in the water, and then extrapolating the temperature rise with the aid of a temperature response characteristic similar to those shown in FIG. 3.

Next, in step 230, the conductivity of the water, which water is meant to be essentially detergent-free, is calculated, with a correction for its temperature on the basis of correction data that comprise a temperature dependence of the electrical conductivity of the water. In step 240, a set point is determined as the sum of the corrected conductivity and a conductivity of detergent dissolved in water of the same temperature as the determined water temperature. The conductivity of the detergent dissolved in water is the conductivity at 60° C., which is a temperature near or at the washing temperature and for which standard conductivity values are known in the art. In an alternative embodiment, the conductivity of detergent dissolved in water is obtained from a table that lists the conductivity at a number of temperatures near the washing temperature.

In step 250, an alarm signal is triggered if the measured conductivity is lower than the set point, which result in the flashing emission of red light with a high intensity by a led, as indicated by step 260. In the same step 250, the led will be activated to emit green light, as indicated by step 270. This serves the purpose of indicating that a sufficient amount of detergent is present in the washing water. The step 250 is followed by step 280, in which step the electrical conductivity of the water is determined again. In normal use, this second measurement takes place in water with detergent dissolved therein. The temperature of the water is also determined again, this time without extrapolation. The steps 250 and 280 are repeated at a regular interval during a dish-washing cycle (indicated by arrow 290). Once the device is taken out of the water, preferably after the washing cycle has been completed, the device goes from an active mode to a sleep mode (this transition is not shown in FIG. 5).

Figure 6:
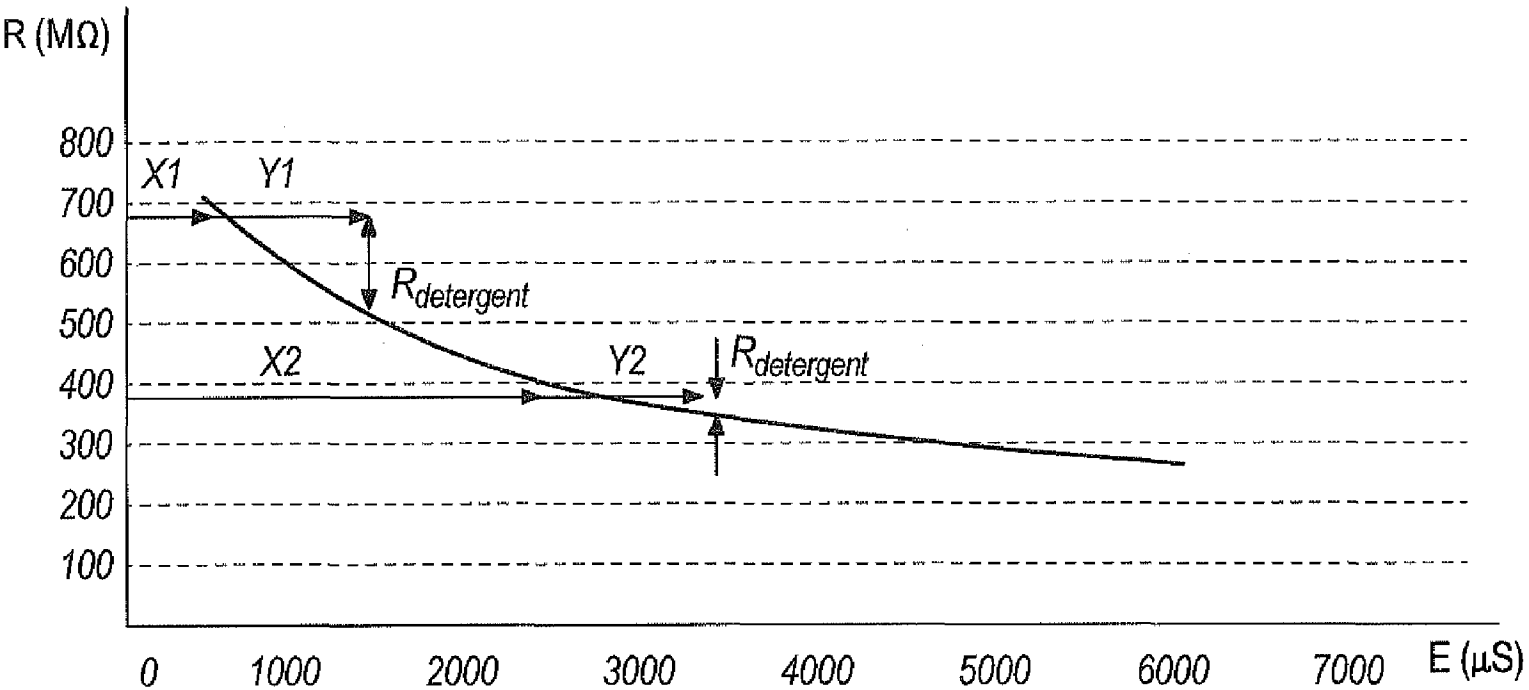
FIG. 6 is a graph that schematically illustrates the provision of conductivity measurement data in an embodiment of the device of the invention.

In FIG. 6 is shown how the electrical conductivity of the liquid is determined from a measured resistance value of the liquid between the two electrodes 5. First, the resistance value is determined by measuring an electrical current at a given voltage over both electrodes 5. Next, the electrical conductivity is read from a curve that relates resistance to conductivity as experimentally determined at an earlier stage, of which curve FIG. 6 shows an example.

FIG. 6 also shows how from the set point for the electrical conductivity, as determined in step 240 of FIG. 5, a set point for electrical resistance is determined. The set point for electrical conductivity, step 240, is determined by adding the determined conductivity of essentially detergent-free water to the conductivity of water with detergent dissolved therein, as represented in FIG. 6 by X1 respectively Y1 for one situation, and X2 respectively Y2 for another situation. Next, the set point for electrical resistance is read from the curve at the conductivity set point thus calculated. The value X1 represents a situation of water with relatively few electrically conducting particles in the water, such as ionized salts, which is regarded 'soft water'. The value X2 represents 'hard water'. The value Y1, Y2 represents in this example a detergent concentration of 0.9 gram/liter, which is equivalent to a conductivity of 1600 μSiemens.

The shown examples are given only for illustrative purposes, and are not to be taken as limitative. For instance, the circuit of FIG. 2 does not have to be part of a self-contained and wireless monitoring device for a small industrial dish-washing machine, but may instead be installed as a fixed part of a large washing machine. Moreover, the temperature range of measurement may differ from the interval between 32.5° C. and 37.5° C. as used in the example. Various other modifications are possible, without leaving the scope of the invention, as defined in the following claims.

The invention claimed is:

1. A sensing device capable of determining a temperature of a liquid and an electrical conductivity of said liquid at said temperature, wherein said sensing device comprises at least one temperature sensor for providing temperature measurement data arranged such that said temperature sensor is physically isolated from said liquid when said sensing device is immersed in said liquid, said device further comprising:

an electrical conductivity sensor arranged for providing conductivity measurement data for determining an electrical conductivity of said liquid;

storage means containing one or more temperature response characteristics of said temperature sensor, each temperature response characteristic indicating temperature variations of said temperature sensor as a function of time in a temperature interval;

a processor for processing said conductivity measurement data and said temperature measurement data of said electrical conductivity sensor and said at least one temperature sensor wherein said processor is arranged for:

substantially instantly measuring said electrical conductivity, when said sensing device is immersed in said liquid, on the basis of said conductivity measurement data, and evaluating said temperature measurement data of said temperature sensor measured when said sensing device is immersed in said liquid, in a fraction of said temperature interval of said temperature characteristic between an initial temperature and an intermediate temperature measured by said temperature sensor after immersion in said liquid and thereby determining the temperature of said liquid using one or more of said stored temperature response characteristics.

2. The sensing device according to claim 1, wherein said storage means contains correction data concerning a temperature dependence of the electrical conductivity of said liquid, and said processor is arranged for correcting said determined electrical conductivity on the basis of said correction data to determine a corrected electrical conductivity at a further temperature different from said temperature of said liquid.

3. The sensing device according to claim 1, wherein said fraction of said temperature interval for evaluating said temperature measurement data is less than 0.25.

4. The sensing device according to claim 1, wherein said temperature interval ranges from approximately 20° C. to approximately 60° C.

5. The sensing device according to claim 1, wherein said fraction of said temperature interval for evaluating said temperature data is a predetermined, fixed temperature interval.

6. The sensing device according to claim 5, wherein said predetermined, fixed temperature interval ranges from approximately 32.5° C. to approximately 37.5° C.

7. The sensing device according to claim 1, wherein said processor is arranged for determining said temperature of said liquid by timing a temperature variation measured by said temperature sensor between said initial temperature and said intermediate temperature.

8. The sensing device according to claim 1, wherein said processor is arranged for storing in said storage means said determined electrical conductivity, and for replacing said stored determined electrical conductivity by a new determined electrical conductivity value if said new determined electrical conductivity is lower than said stored determined electrical conductivity.

9. The sensing device according to claim 1, wherein said storage means contains data concerning the detergent electrical conductivity of a detergent dissolved in said liquid at said further temperature of said liquid, and said processor is arranged for determining a conductivity threshold value indicative of a shortage of detergent in said liquid, said threshold value being the sum of said determined electrical conductivity or said corrected electrical conductivity and said detergent electrical conductivity.

10. The sensing device according to claim 9, wherein said processor is arranged for determining an electrical conductivity value of said liquid containing dissolved detergent and for providing an alarm signal upon determining a value for said electrical conductivity value liquid containing dissolved detergent that is lower than said threshold value.

11. The sensing device according to claim 10, wherein said sensing device comprises signalling means arranged such that said signalling means are activated in response to said alarm signal.

12. The sensing device according to claim 1, wherein said sensing device is a self-contained and wireless device capable of floating in said liquid.

13. A method for determining a temperature of a liquid and an electrical conductivity of said liquid at said temperature by a sensing device capable of determining said temperature and said electrical conductivity, wherein said sensing device comprises at least one temperature sensor for providing temperature measurement data arranged such that said temperature sensor is physically isolated from said liquid when said sensing device is immersed in said liquid, and wherein said sensing device comprises at least one sensor for providing conductivity measurement data for determining an electrical conductivity of said liquid, said method comprising the steps of:

substantially instantly measuring said electrical conductivity on the basis of said conductivity measurement data of said conductivity sensor, evaluating said temperature measurement data between an initial temperature and an intermediate temperature after immersion of said sensing device in said liquid, said intermediate temperature being lower than said temperature of said liquid, and determining said temperature of said liquid by comparing said evaluated temperature measurement data with temperature response characteristics of said temperature sensor, each of said temperature response characteristic indicating temperature variations of said temperature sensor as a function of time in a temperature interval, wherein said temperature interval includes said initial temperature and said intermediate temperature.

14. The method according to claim 13, further comprising the step of correcting said determined electrical conductivity on the basis of correction data, said correction data concerning a temperature dependence of the electrical conductivity of said liquid, to determine a corrected electrical conductivity at a further temperature differing from said temperature of said liquid.

15. The method according to claim 13, wherein said initial temperature and said intermediate temperature determine a range being a fraction of said temperature interval and wherein said fraction is less than 0.25.

16. The method according to claim 13, wherein said temperature interval ranges from approximately 20° C. to approximately 60° C.

17. The method according to claim 13, wherein said initial temperature and intermediate temperature determine a predetermined, fixed temperature interval.

18. The method according to claim 17, wherein said predetermined, fixed temperature interval ranges from approximately 32.5° C. to approximately 37.5° C.

19. The method according to claim 13, wherein said method further comprising the step of determining a time interval for a temperature variation between said initial temperature and said intermediate temperature.

20. The method of according to claim 13, further comprising the steps of storing said determined electrical conductivity, replacing said determined electrical conductivity when by a new determined electrical conductivity if said new determined electrical conductivity is lower than said stored electrical conductivity value.

21. The method according to claim 20, further comprising the steps of:

measuring an electrical conductivity of said liquid with dissolved detergent, and providing an alarm signal if said measured electrical conductivity of said liquid with dissolved detergent is lower than said threshold value.

22. The method according to claim 13, further comprising the step of determining a conductivity threshold value indicative of a shortage of detergent in said liquid, said threshold value being the sum of one of said electrical conductivity or corrected electrical conductivity and an electrical conductivity of a detergent dissolved in said liquid at one or more of said liquid temperature and said further temperature.

23. The method according to claim 22, wherein a signalling means is activated in response to said alarm signal.

* * * * *